US007296735B2

(12) United States Patent
Tennant

(10) Patent No.: US 7,296,735 B2
(45) Date of Patent: Nov. 20, 2007

(54) MEDIA THICKNESS SENSOR ASSEMBLY

(75) Inventor: Alan Tennant, Drum (GB)

(73) Assignee: NCR Corporation, Dayton, OH (US)

( * ) Notice: Subject to any disclaimer, the term of this patent is extended or adjusted under 35 U.S.C. 154(b) by 25 days.

(21) Appl. No.: 11/305,574

(22) Filed: Dec. 16, 2005

(65) Prior Publication Data

US 2007/0138278 A1 Jun. 21, 2007

(51) Int. Cl.
*G07F 19/00* (2006.01)

(52) U.S. Cl. ..... 235/379

(58) Field of Classification Search ..... 235/379, 235/439; 902/19
See application file for complete search history.

(56) References Cited

U.S. PATENT DOCUMENTS 3,624,494 A * 11/1971 Turan ..... 324/653
4,107,606 A * 8/1978 Typpo et al. ..... 324/229
4,446,427 A * 5/1984 Lovrenich ..... 324/207.16
4,989,520 A * 2/1991 Hain ..... 109/24.1
6,218,729 B1 * 4/2001 Zavrel et al. ..... 257/698
2001/0013541 A1 * 8/2001 Modi ..... 235/379
2005/0035836 A1 * 2/2005 Howard et al. ..... 335/205

* cited by examiner

*Primary Examiner*—Michael G. Lee
*Assistant Examiner*—Paultep Savusdiphol
(74) *Attorney, Agent, or Firm*—Priest & Goldstein PLLC

(57) ABSTRACT

A thickness sensor assembly (200) for a self-service terminal (SST) arranged to dispense media from at least one media cassette. The sensor assembly comprises a platform (202) and a resonant circuit (300) mounted on the platform (202) and resiliently biased towards a rest position, the sensor assembly (200) being arranged such that the displacement of the resonant circuit (300) can be detected by an SST in which the platform (202) is mounted. In use, the platform (202) is mounted in an SST adjacent to a feed path (72) of media being dispensed thereby such that media moving along the feed path (72) displaces the resonant circuit (300). Such a sensor assembly (200) can be used to detect, for example, when two media sheets have been picked up instead of one.

11 Claims, 5 Drawing Sheets

MEDIA THICKNESS SENSOR ASSEMBLY

TECHNICAL FIELD

The present invention relates to a media thickness sensor assembly. It is particularly related to, but in no way limited to, a media thickness sensor assembly in a self-service terminal (SST) such as an automated teller machine (ATM).

BACKGROUND

Thickness sensors are usually employed in SSTs or ATMs to determine whether the expected number of media sheets is present at a particular point during processing of the media and in particular to detect double or multiple picking where only one item of media should have been picked. In an ATM, the thickness of notes which go to make up the stack of notes which is presented to a user of the machine is checked during their transportation through the dispenser unit. If a reading is thicker than expected, it is assumed that the pick means has, for example, picked up two notes rather than one and the stack of notes is not presented to the user. Instead, the stack is diverted to a purge bin.

The use of a note thickness sensor in an ATM can be described with reference to FIG. 1 which shows a schematic side elevation view of a cash dispenser unit 73 of an ATM. The cash dispenser unit 73 holds a number of currency cassettes 89 each holding a stack of currency notes 68. Each cassette 89 holds only one denomination of currency notes, but different cassettes may contain different denominations. The notes 68 are held in place in the cassette by means of a pusher plate 69 which urges the stack of notes to one end of the cassette.

When one or more notes are to be dispensed from a particular cassette 89, the pick mechanism 74 associated with the cassette 89 draws a note from the cassette 89 such that its leading edge is gripped between drive rollers 90. The note is then fed along the feed path 72 by further drive rollers 92, through a retard mechanism 10 to a stacker wheel assembly 75. The stacker wheel assembly 75 comprises a hub 76 bearing tines 78 and is arranged to rotate on a shaft 77. As each note passes along the feed path 72, its thickness is checked by a compensated capacitance thickness sensor 118, in order to detect whether more than one note has been picked up inadvertently. In operation, the stacker wheel assembly 75, which comprises a hub 76 bearing tines 78 and arranged to rotate on a shaft 77. The stacker wheel assembly 75 rotates continuously in a counter-clockwise direction (for the arrangement shown in FIG. 1) and the note is fed into a compartment 81 formed between adjacent tines 78. If more than one note is to be dispensed, each note is fed into a successive compartment 81 as the stacker wheel assembly 75 rotates. Having completed half a rotation, the note is removed from the stacker wheel assembly 75 by fingers 94 of a stripper plate assembly 96 pivotally mounted on a shaft 98. Once removed from the stacker wheel, the note is placed on a belt 100 resting against the stripper plate assembly 96 and any subsequent notes which are to be dispensed simultaneously with the first note are placed on top of the first note to form a bundle 68'. When the required amount of notes (which may be just one note) have been assembled into the bundle 68', a pair of belts 102 (only one of which is shown in FIG. 1) is rotated on a shaft 104 such that the bundle 68' is trapped between the belts 100, 102. The bundle is then fed between belts 100, 102, 106, 108 through a note exit slot 110 in the housing 112 of the cash dispenser unit 73 usually to a position where the bundle 68' can be collected by the user of the ATM.

If a multiple feeding is detected by the thickness sensor 118 or one or more of the notes are rejected for any reason, the bundle is not fed to the note exit slot 110. Instead the stripper plate assembly 96 is pivoted into a position as shown by the dashed outline 96' and the belts 100, 102 are operated in the reverse direction to deposit the bundle 68' into a reject note container 114 via an opening 116.

The compensated capacitance sensor 118 is neither as cheap nor as robust as is desirable. In normal use and in particular during maintenance and replacing media cassettes 89, sensors 118 tend to become inaccurate or become offset. This either results in multiple feeding not being detected or correctly assembled bundles being rejected. This means that the purge bin 114 becomes full and has to be emptied and the media cassettes 89 run out of notes more quickly than could otherwise be the case, requiring refilling. Faults require servicing the compensated capacitance sensor 118, which is a part of the machine which is not readily accessible.

SUMMARY

According to a first aspect of the present invention, there is provided a thickness sensor assembly for a self-service terminal (SST) arranged to dispense media, the sensor assembly comprising a platform and a resonant circuit mounted on the platform and resiliently biased towards a rest position, the sensor assembly being arranged such that a displacement of the resonant circuit from its rest position can be detected by an aerial and the platform being arranged to be mounted in an SST adjacent to a feed path of media being dispensed thereby such that media moving along the feed path displaces the circuit.

This is advantageous as a resonant circuit is more robust and cheaper to manufacture than prior art solutions such as compensated capacitance sensors. Further, the displacement of a resonant circuit from its rest position may be detected, rather than its distance from a sensor. This means that there will be no absolute measurement errors due to incorrect placement or shifting of the sensor.

Preferably, the resonant circuit is electrically passive. This is advantageous as it contributes to the robustness of the sensor; an electrically passive sensor is less likely to fail.

Preferably, the platform comprises mounting means arranged such that the platform is readily removable from an SST in which the sensor assembly is installed. This may be achieved by situating the platform towards the back, or the service side, of the SST. The platform may comprise a 'slide-out' member, or drawer, designed to slot, slide or similarly be brought into place in the SST. This is advantageous as it provides a solution to thickness sensing which is in-line with the desire to make machines such as SSTs modular, allowing components thereof to be removed and replaced if faulty, rather than requiring on-site repair or the complex and expensive process of moving the SST to a repair shop. As the sensor is a resonant circuit, it is more robust than prior art solutions and is therefore more suited to being mounted on a removable platform. Where the resonant circuit is electrically passive, it will not require disconnection from an input/output means and is also more suited to being mounted on a removable platform.

The thickness sensor assembly may further comprise at least one aerial mounted on the platform comprising at least one receive circuitry and at least one output means, the aerial being arranged, in use, to detect the displacement of the or each resonant circuit based on a signal received by the aerial and to output a signal indicative or the detected displacement via the output means. This is advantageous as such as assembly therefore comprises all the components necessary to detect media thickness.

Preferably the aerial further comprises transmit circuitry for generating an alternating electromagnetic field. This advantageously provides a magnetic field which will be affected by a displacement of the resonant circuit, and this effect may be detected by the aerial.

Preferably, in embodiments where the aerial comprises transmit circuitry, the aerial and the resonant circuit are arranged such that a face of the aerial is opposed to and substantially parallel to the face of the resonant circuit and further arranged such that, in use of the sensor assembly, a displacement by media moving along the feed path of the resonant circuit is substantially parallel to the plane of the opposed faces. This is advantageous as the relative movement of the faces will have an effect on the alternating electromagnetic field which is readily detectable.

Preferably the sensing assembly further comprises processing means for calculating media thickness based on the displacement of the or each resonant circuit. Advantageously this provides an accurate indication of the media thickness which can be compared to an expected thickness to determine whether the media has been correctly placed.

Preferably, the platform comprises a rigid member. This is advantageous as any flexing in the platform will contribute to errors in measuring the thickness of media passing through the sensor assembly.

According to a second aspect of the present invention, there is provided a self service terminal (SST) comprising at least one media cassette, at least one pick means arranged to pick media from the or each media cassette and a transport mechanism arranged to transport media picked by the pick means to an outlet of the SST, the SST further comprising an aerial and at least one thickness sensor assembly comprising at least one resonant circuit resiliently mounted on a platform and arranged such that the or each resonant circuit is displaced by media moving through the transport mechanism and further arranged such that, in use of the SST, the displacement of the or each resonant circuit may be detected by the aerial.

In perhaps a preferred embodiment, the SST comprises an ATM.

The SST may further comprise processing means for calculating media thickness based on the displacement of the or each resonant circuit.

The thickness sensor assembly of the SST may have any of the features described in relation to the first aspect of the invention.

A third aspect of the present invention provides a method of detecting thickness of media comprising generating an alternating magnetic field, arranging a arranging a resonant circuit sensor assembly in that field, causing the media to move along a feed path such that the resonant circuit sensor assembly is displaced by the media, detecting the effect of the displacement on the magnetic field and determining, from the detected effect, the thickness of the media.

The method may be performed by firmware or software in machine readable form on a storage medium.

This acknowledges that firmware and software can be valuable, separately tradable commodities. It is intended to encompass software, which runs on or controls "dumb" or standard hardware, to carry out the desired functions. For similar reasons, it is also intended to encompass software which "describes" or defines the configuration of hardware, such as HDL (hardware description language) software, as is used for designing silicon chips, or for configuring universal programmable chips, to carry out desired functions.

The preferred features may be combined as appropriate, as would be apparent to a skilled person, and may be combined with any of the aspects of the invention.

BRIEF DESCRIPTION OF THE DRAWINGS

Embodiments of the invention will be described, by way of example, with reference to the following drawings, in which.

DETAILED DESCRIPTION

Figure 1:
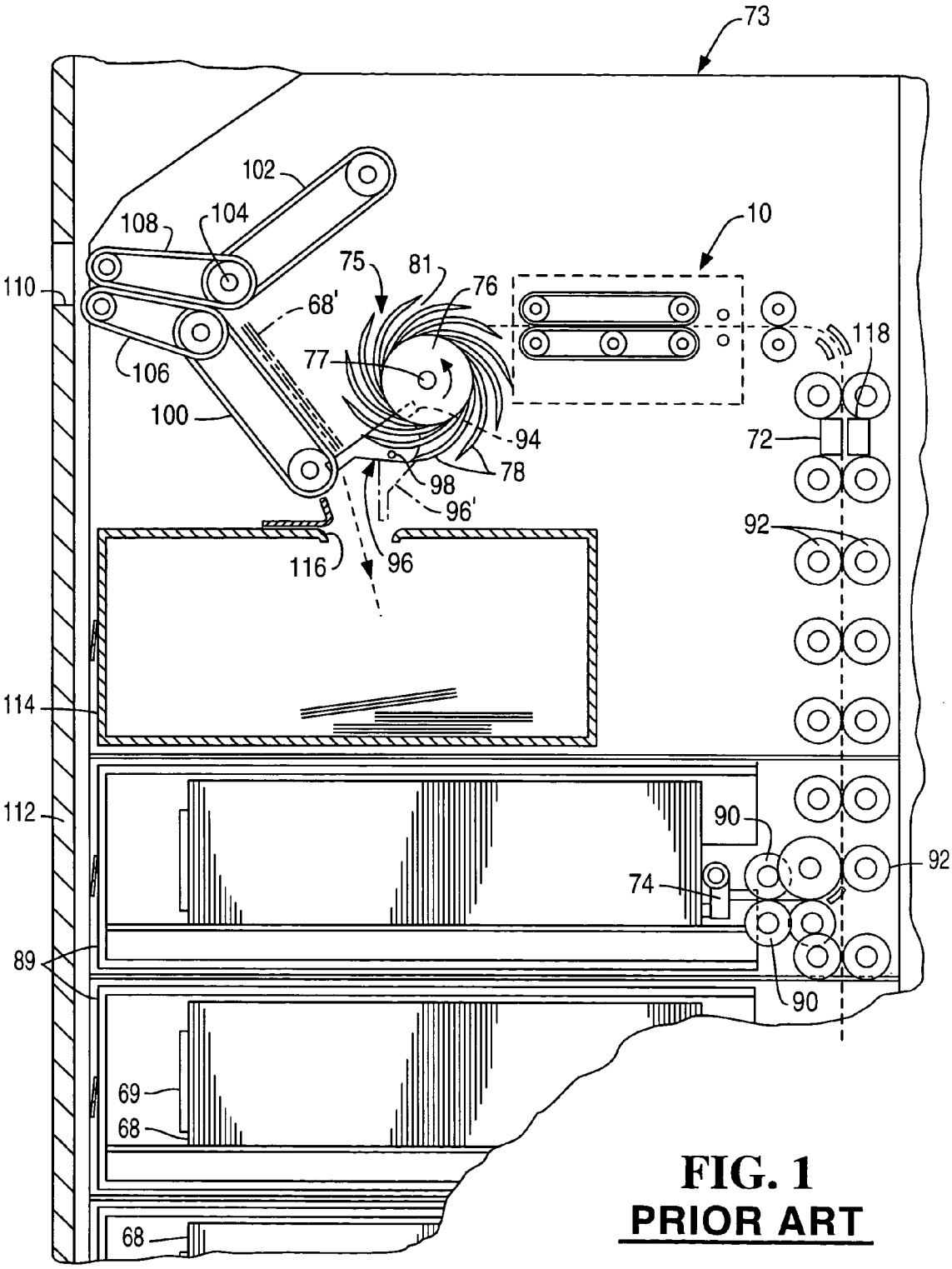
FIG. 1 PRIOR ART
FIG. 1 is a schematic side elevation of a cash dispenser unit of a prior art ATM.

Common reference numerals are used throughout the figures to indicate similar features.

Embodiments of the present invention are described below by way of example only. These examples represent the best ways of putting the invention into practice that are currently known to the Applicant although they are not the only ways in which this could be achieved.

FIG. 1 shows a side view of prior art cash dispenser unit 73 of an Automated Teller Machine (ATM) and has been described above.

Figure 2:
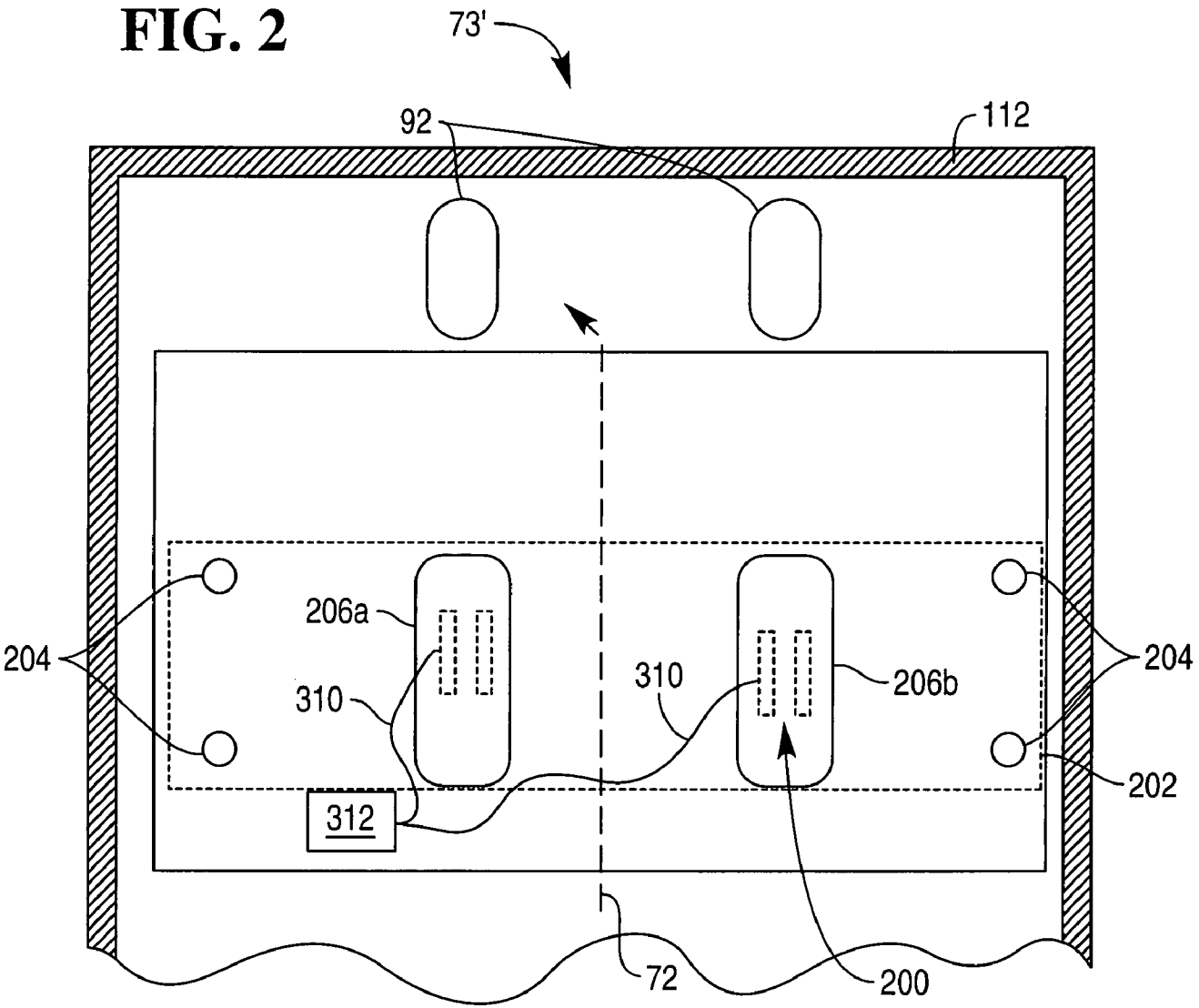
FIG. 2 is a simplified schematic diagram of a portion of a back view of a cash dispenser unit including a thickness sensor according to one embodiment of the present invention.

FIG. 2 shows a back view of a portion of a cash dispenser unit 73' according to one embodiment of the present invention.

The cash dispenser unit 73' is similar to that shown in FIG. 1 but differs in that it the compensated capacitance sensors 118 have been removed and replaced with resonant circuit sensor assemblies 200 mounted on a rigid metal platform 202, which in turn is mounted on the housing 112 of the cash dispenser unit 73' at four mounting points 204 which comprise bolt holes and provide mounting means for removably mounting the platform 202 in the cash dispenser unit 73'. The view shown is at the top of the feed path, adjacent the uppermost drive rollers 92, which in this case comprise a pair of wheels 206*a*, 206*b*.

Figure 3:
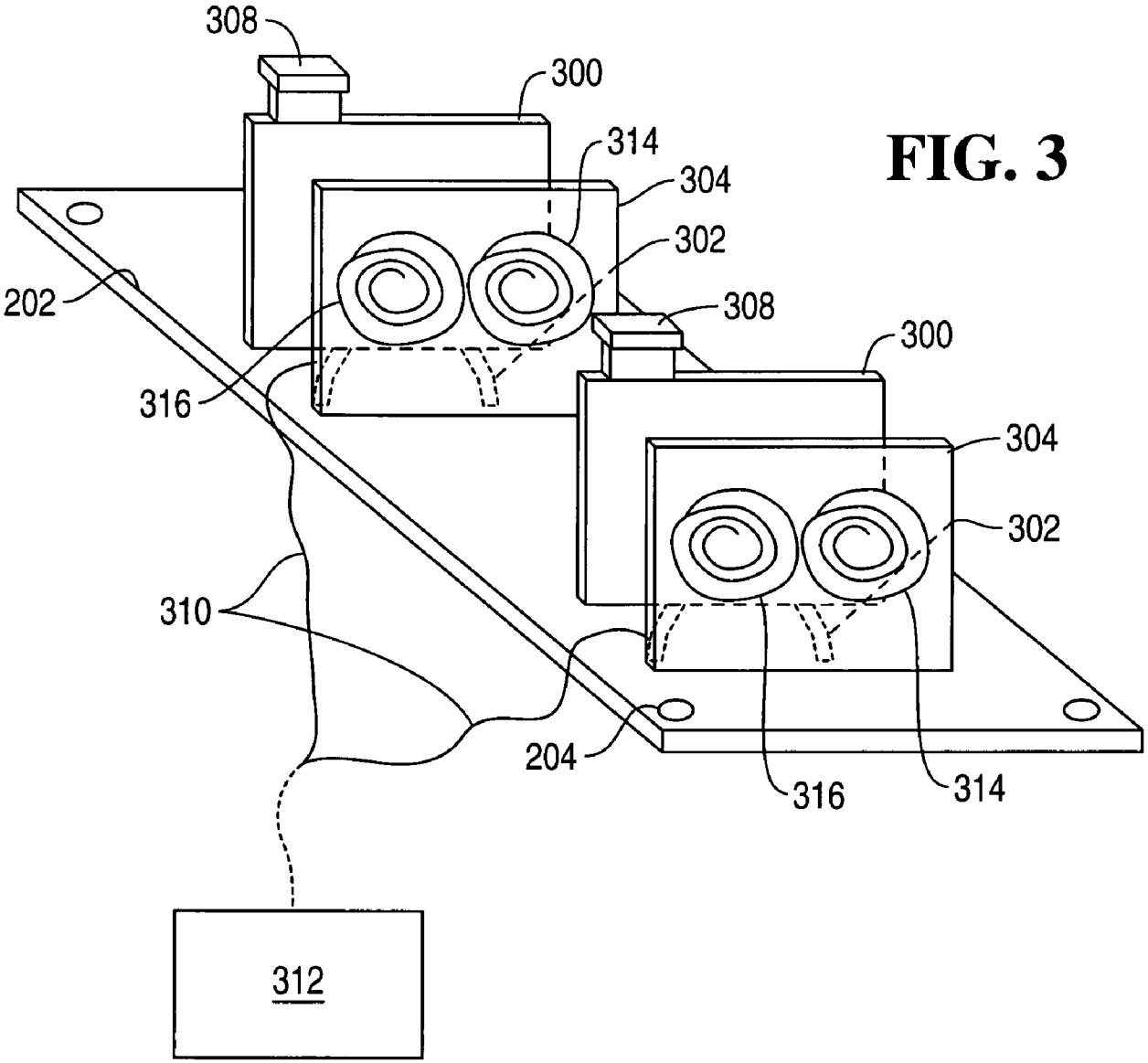
FIG. 3 shows a schematic arrangement for a thickness sensor assembly according to one embodiment of the present invention.

The resonant circuit sensor assemblies 200 are illustrated in greater detail in FIG. 3 and each comprise a printed circuit board (PCB) 300 mounted on the platform 202 on a resilient mounting 302 and an aerial 304, which comprises a further resonant circuit PCB and which is linked via an output means 310 to processing means 312 in the dispenser unit 73' (not shown).

The aerials 304 each comprise transmit circuitry 314 arranged to generate an alternating electromagnetic field and receive circuitry 316, also shown schematically in FIG. 3.

The resiliently mounted resonant circuit 300 may, for example, comprise a Sensopad (trade mark) puck, and the aerial 304 may, for example, comprise a Sensopad (trademark) pad as produced by Sensopad Technologies Ltd. The resiliently mounted resonant circuit 300 will be referred to herein a puck and the aerial 304 will be referred to herein as a pad, however a skilled person will appreciate that resonant circuits and aerials other than those supplied by Sensopad Technologies Ltd may be used.

The sensing system relies on inductance to operate, with transmit circuitry 314 in the pad 304 generating an alternating electro-magnetic field which induces currents in the puck 300. As a result of these induced currents, each puck generates an alternating electromagnetic field and the resultant electromagnetic field is detected by receive circuitry 316 in the pad 304. The receive circuitry 316 in the pad are electrically isolated from the transmit circuitry 314 in the pad 304. The processing means 312 can determine, from the received signal, the positions of a puck 300 relative to the pad 304.

Each puck 300 further comprises a contact member 308. When in position within the dispenser unit 73' as is shown in FIG. 2, each contact member is urged against a wheel 206*a*, 206*b*. The arrangement is such that, when a note moves along the feed path 72, it passes between the wheels 206*a*, 206*b* and the contact member 306. This causes the pucks 300 to move relative to their adjacent pads 304. This causes a signal indicative of the displacement to be sent via the output means 310 to the processing circuitry, which then determines whether double or multiple picking has occurred by comparing the measured thickness with a predetermined expected thickness.

Relative movements of puck 300 and the pad 304 as small as 5 microns can be detected with such a system. Bank notes tend to have a thickness on the order of 50 to 100 microns, depending on currency, the denomination and the like. Therefore the puck 300 and the pad 304 provide a sensor accurate enough to determine whether one or two bank notes are passing.

As will be appreciated by the person skilled in the art, the expected thickness of a note will vary for different currencies but will be known for a specific currency.

If a 'multiple feeding' is detected by the resonant circuit sensor 200 in feeding the notes, a bundle 68' including the multiple feeding is not fed to the note exit slot 110. Instead the stripper plate assembly 96 is pivoted into a position as shown by the dashed outline 96' in FIG. 1 and the belts 100, 102 are operated in the reverse direction to deposit the bundle 68' into a reject note container 114 via an opening 116. The pick operation then repeats to assemble a new bundle.

Figure 4:
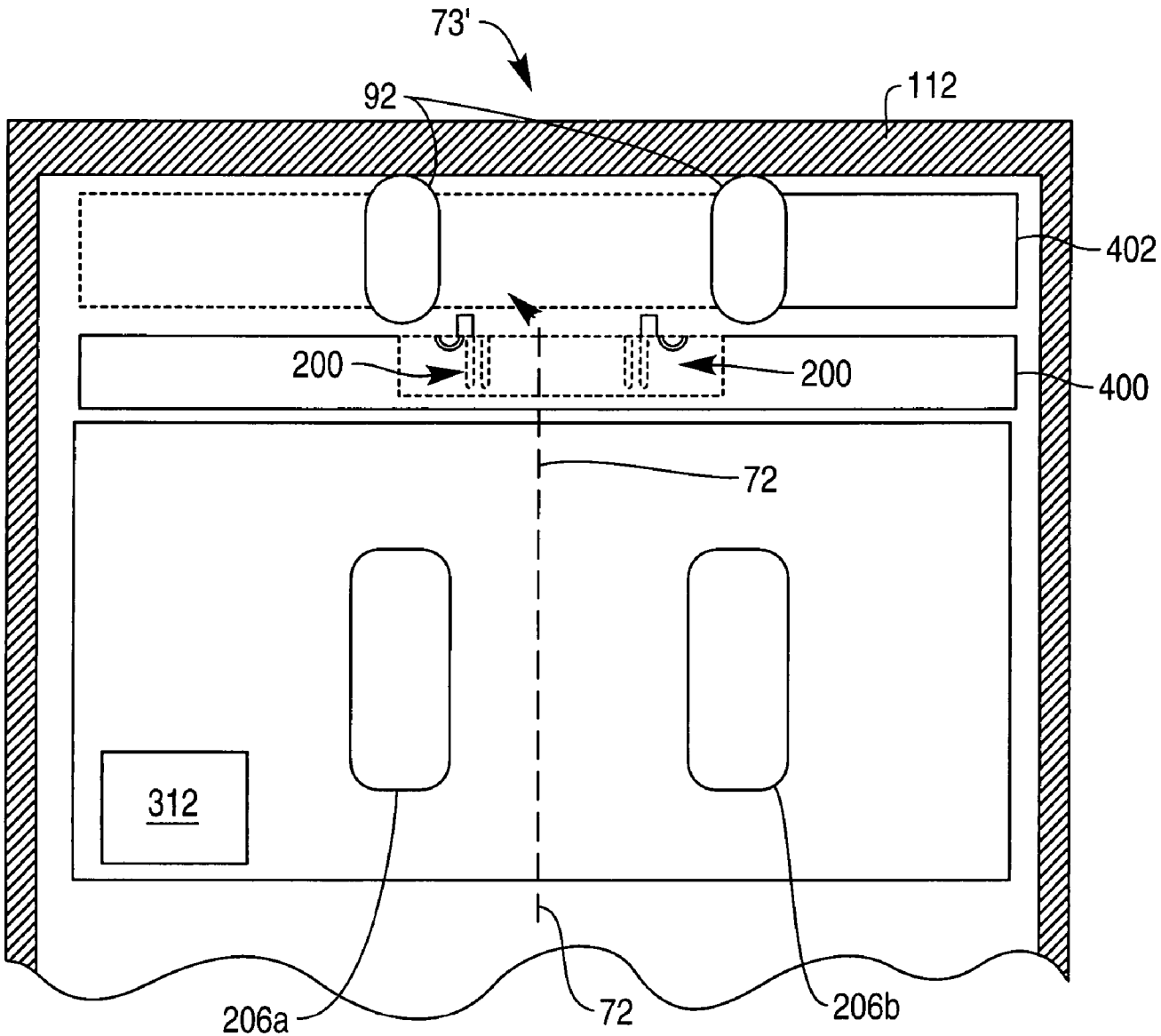
FIG. 4 is a simplified schematic diagram of a portion of a back view of a cash dispenser unit including a thickness sensor according to a second embodiment of the present invention.
Figure 5:
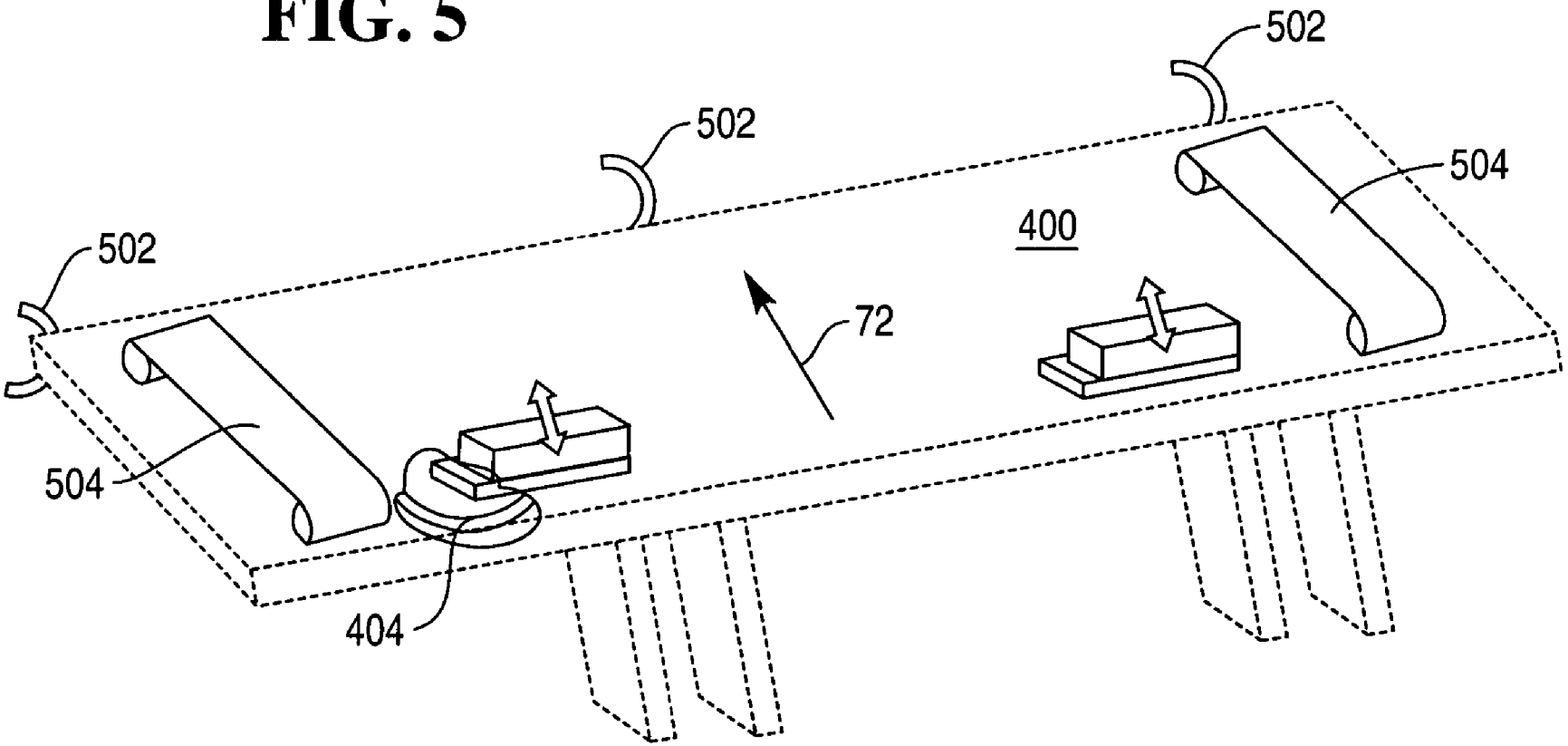
FIG. 5 shows a schematic arrangement for a thickness sensor assembly according to the second embodiment of the present invention.

A second embodiment of the invention is now discussed with reference to FIG. 4. In FIG. 4, the platform is provided by a removable drawer 400 on which the resonant circuit sensor assembly 200 is mounted. The drawer 400 as shown in greater detail in FIG. 5 comprises mounting means in the form of 'click-in' connection means 502. These comprise C-shaped resilient plastic members arranged to co-operate with parts of the cash dispenser unit 73' (not shown), such that it clicks into place but can be removed there from. The connection means 502 therefore comprise mounting means for removably mounting the drawer 400 in the cash dispenser unit 73'. The drawer 400 further comprises a pair of belts 504 which are driven to move a note along the feed path 72.

In this embodiment, the puck 300 and the pad 304 are mounted on the side of the drawer 400 away from the feed path 72 and the contact member 306 protrudes through the drawer into the feed path 72. The puck 300 and the contact member 306 are resiliently mounted on a leaf spring 404, one end of which is fixed to the drawer 400.

When in position within the cash dispenser unit 73', as is shown in FIG. 4, each contact member 306 is urged against a rigid plastic chassis portion 402. The arrangement is such that, when a note moves along the feed path 72, it passes between chassis portion 402 and the contact member 306. This causes the pucks 300 to move relative to their adjacent pads 304. This causes a signal indicative of the displacement to be sent via the output means 308 to the processing circuitry 312, which then determines whether double picking has occurred by comparing the measured thickness with a predetermined expected thickness, as discussed above.

Other embodiments and/or combinations of features from the above embodiments will be readily apparent to the man skilled in the art. For example, sensor assemblies according to one aspect may be embodied in self service terminals other than ATMs. Other components of the dispensing unit may vary from those described herein. For example, the bundle of notes may be formed in a shuttle which transports the bundle to the note exit point 110.

What is claimed is:

1. A thickness sensor assembly for a self-service terminal (SST) arranged to dispense media, the sensor assembly comprising a platform and a resonant circuit mounted on the platform and resiliently biased towards a rest position, the resonant circuit comprising a contact member urged against a surface when the resonant circuit is in the rest position, displacement of the resonant circuit from the rest position occurring when media passes between the surface and the contact member, forcing the contact member away from the surface, the sensor assembly being arranged such that a displacement of the resonant circuit from its rest position can be detected by an aerial and the platform being arranged to be mounted in an SST adjacent to a feed path of media being dispensed thereby such that media moving along the feed path displaces the circuit.

2. A thickness sensor assembly according to claim 1 in which the resonant circuit is electrically passive.

3. A thickness sensor assembly according to claim 1 in which the platform comprises mounting means arranged such that the platform is readily removable from an SST in which the sensor assembly is installed.

4. A thickness sensor assembly according to claim 1 which comprises at least one aerial mounted on the platform comprising at least one receive circuitry and at least one output means, the aerial being arranged, in use, to detect the displacement of the or each resonant circuit based on a signal received by the aerial and to output a signal indicative or the detected displacement via the output means.

5. A thickness sensor assembly according to claim 4 in which the aerial further comprises transmit circuitry for generating an alternating electro-magnetic field.

6. A thickness sensor assembly according to claim 5 in which the aerial and the resonant circuit are arranged such that a face of the aerial is opposed and substantially parallel to the face of the resonant circuit and further arranged such that, in use of the sensor assembly, a displacement caused by media moving along the feed path of the resonant circuit is substantially parallel to the plane of the opposed faces.

7. A thickness sensor assembly according to claim 1 which comprises processing means for calculating media thickness based on the displacement of the or each resonant circuit.

8. A thickness sensor assembly according to claim 1 in which the platform comprises a rigid member.

9. A self service terminal comprising at least one media cassette, at least one pick means arranged to pick media from the or each media cassette and a transport mechanism arranged to transport media picked by the pick means to an exit of the self service terminal, the self service terminal further comprising at least one thickness sensor assembly comprising at least one resonant circuit mounted on a platform and resiliently biased against the transport mechanism, the sensor assembly being arranged such that the or each resonant circuit is displaced by media moving through the transport mechanism, each resonant circuit comprising a contact member urged against a surface when the resonant circuit is in the rest position, displacement of the resonant circuit from the rest position occurring when media passes between the surface and the contact member, forcing the contact member away from the surface, and further arranged such that, in use of the self service terminal, the displacement of the or each resonant circuit may be detected by the aerial.

10. A self service terminal according to claim 9 which further comprises processing means for calculating media thickness based on the displacement of the or each resonant circuit.

11. A method of detecting thickness of media comprising generating an alternating magnetic field, arranging a resonant circuit sensor assembly in that field, causing the media to move along a feed path such that the resonant circuit sensor assembly is displaced by the media, the resonant circuit comprising a contact member urged against a surface when the resonant circuit is in a rest position, displacement of the resonant circuit from the rest position occurring when media passes between the surface and the contact member, forcing the contact member away from the surface, detecting the effect of the displacement on the magnetic field and determining, from the detected effect, the thickness of the media.

* * * * *